United States Patent [19]

Chi

[11] 4,025,031

[45] May 24, 1977

[54] STAPLING MACHINE

[76] Inventor: Hui-Neng Chi, 58 Ta-Chih Road, Taichung, Taiwan, China /Taiwan

[22] Filed: Jan. 29, 1976

[21] Appl. No.: 653,357

[52] U.S. Cl. ..... 227/132; 227/156
[51] Int. Cl.[2] ..... B25C 5/02
[58] Field of Search ..... 227/109, 110, 132, 156

[56] References Cited

UNITED STATES PATENTS

| | | | |
|---|---|---|---|
| 2,716,749 | 9/1955 | Timmerbeil | 227/109 |
| 2,884,636 | 5/1959 | Abrams | 227/132 |
| 3,305,156 | 2/1967 | Khan | 227/110 |
| 3,347,439 | 10/1967 | Doherty | 227/109 |
| 3,348,752 | 10/1967 | Wheble | 227/109 |
| 3,451,606 | 6/1969 | Jacobson | 227/110 |
| 3,758,016 | 9/1973 | Olney et al. | 227/132 |

*Primary Examiner*—Granville Y. Custer, Jr.

[57] ABSTRACT

In a spring-energized stapling machine according to the invention, some provisions are included for extending the function of the machine and preventing any harm possibly caused by the abuse of the machine. These provisions comprise a check plate which can be adjusted to obstruct the operating handle of said stapling machine, a movable fitting serving as a backing plate for paper-fastening in one state and as a safety shield to prevent the driving of staples in an other state, and which can be moved to allow conventional ejection of staples, two different systems of measuring scales engraved on both sides of the foot of said machine, and a novel staple supply which possesses two sets of grooves to accept staples of different sizes and, at its rear, means for staple removal.

3 Claims, 7 Drawing Figures

STAPLING MACHINE

BACKGROUND OF THE INVENTION

In a conventional spring-energized stapling machine, there is provided a strong main spring which provides the power upon the release thereof to drive staples into or through the objects. Such stapling machine does not include means for safety guard, hence, possibly under the abuse of the machine, the flying staples do cause serious harm to human's body or else.

And further, the conventional spring-energized stapling machine has not been equipped with means for paper-fastening as well as staple injection. The function of the machine of the prior art is accordingly limited within a smaller sphere.

SUMMARY OF THE INVENTION

This invention relates to a spring-energized stapling machine, having means for safety guard and paper-fastening as well as staple injecting.

It is the primary aim of the present invention to provide a spring-energized stapling machine including a movable fitting which can be set to prevent, for purpose of safety, unwanted driving of staples or set to form a backing plate for paper-fastening, making the machine capable of two functions.

Another aspect of the invention is to provide a check plate in a spring-energized stapling machine which locks the operating handle to prevent accidental driving of staples.

A further object according to the present invention is to provide means for measuring incorporated in a spring-energized stapling machine in order that, in operation, the precise position on the object to be injected can be conveniently determined.

Still another object of the invention is to provide a spring-energized stapling machine including a staple supply which possesses two sets of grooves whereby making it possible to receive different size staples, and means for staple removal.

According to the present invention, a check plate and a movable fitting are included for safety guard, wherein said check plate can lock the operating handle of the machine and said movable fitting, when at suitable position, prevents the unwanted driving of the staples. The movable fitting has an inverted U-shaped slot engaged with two pins so that said fitting can also be moved to a position serving as a backing plate for the staples for paper-fastening. Two scales, one in centimeters and the other in inches, are engraved on each edge of the base of said machine. And a staple-supply is also provided in the machine having two different sets of grooves ready to accept staples of different sizes. At the end of the supply, there also includes means for staple removal which is needed whenever improper driving occurs.

DETAILED DESCRIPTION OF THE DRAWINGS

Other advantages and objects according to the invention will be apparent from the following descriptions with reference to the accompanying drawings where:

DETAILED DESCRIPTION OF THE PREFERRED EMBODIMETS

Figure 1:
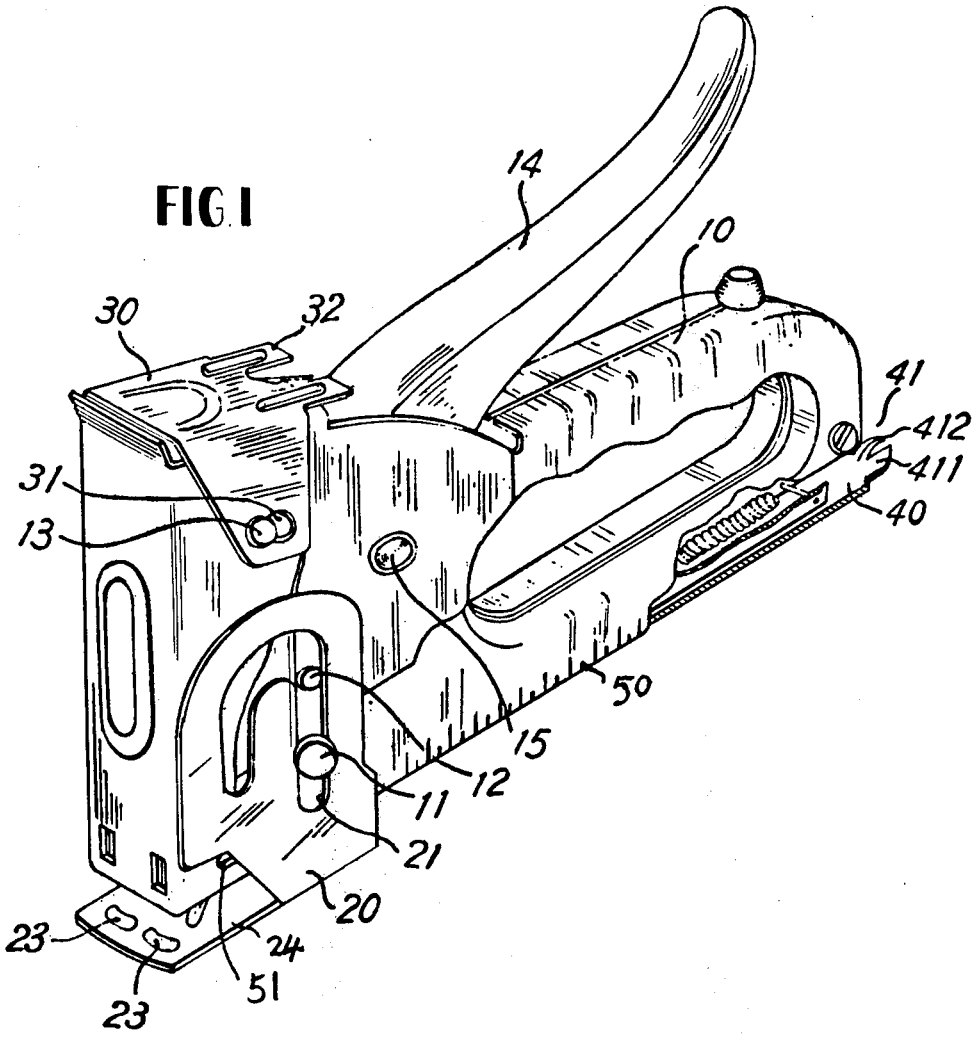
FIG. 1 is a perspective view of a spring-energized stapling machine according to the present invention.

Referring to FIG. 1, the body of the spring-energized stapling machine 10 includes an operating handle 14, a pin 13 defining a slidable mounting for a check plate 30 which can be pushed back and forth for locking and unlocking the said grip arm 14, and two pins 11 and 12 defining two alignment points for a movable fitting 20 the pins sliding in the inverted U-shaped slot 21 contained in the fitting 20. Near the front end of the base 50, said body 10 also includes a small opening 51 for viewing conveniently the staple stock to determined whether it needs to supplementing or not.

Figure 2:
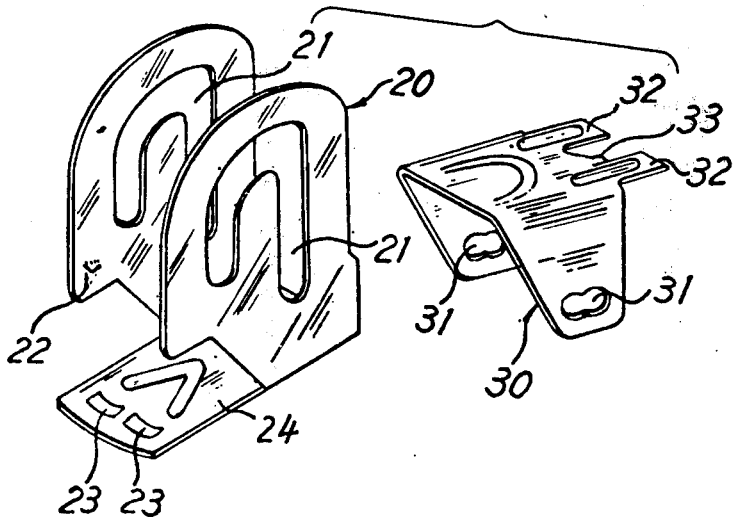
FIG. 2 shows perspective views of a movable fitting and a check plate in the invention respectively.
Figure 7:
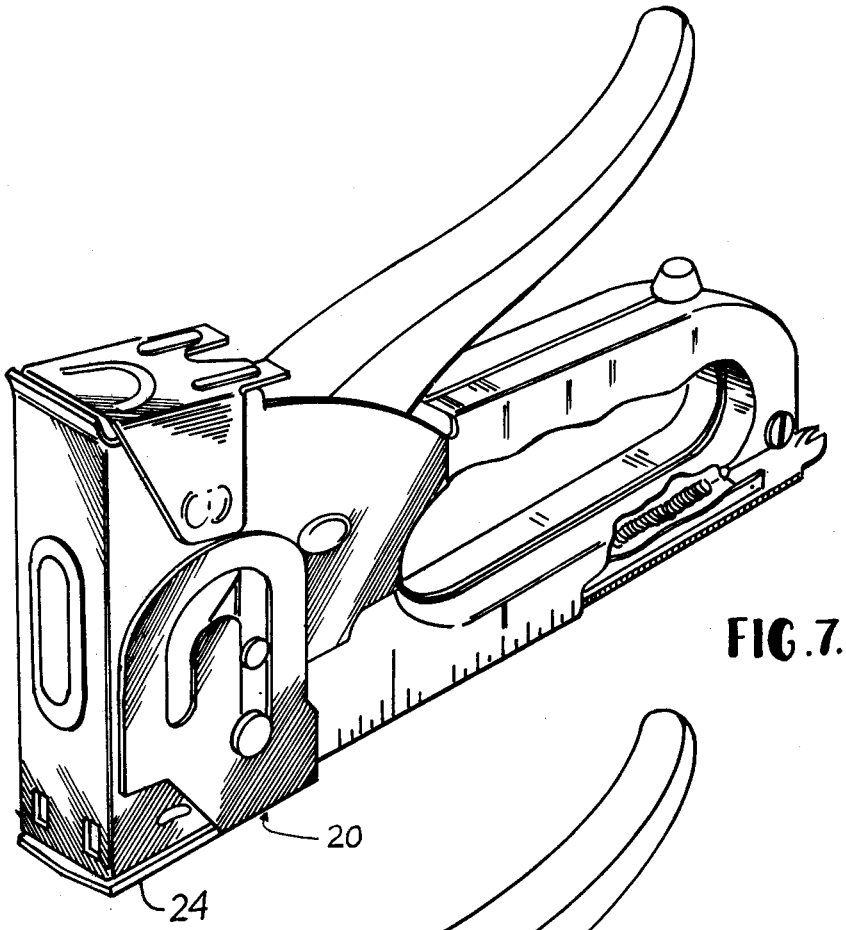
FIGS. 6 and 7 are perspective views of the stapling machine according to the present invention showing alternate positions of the movable fitting.
Figure 6:
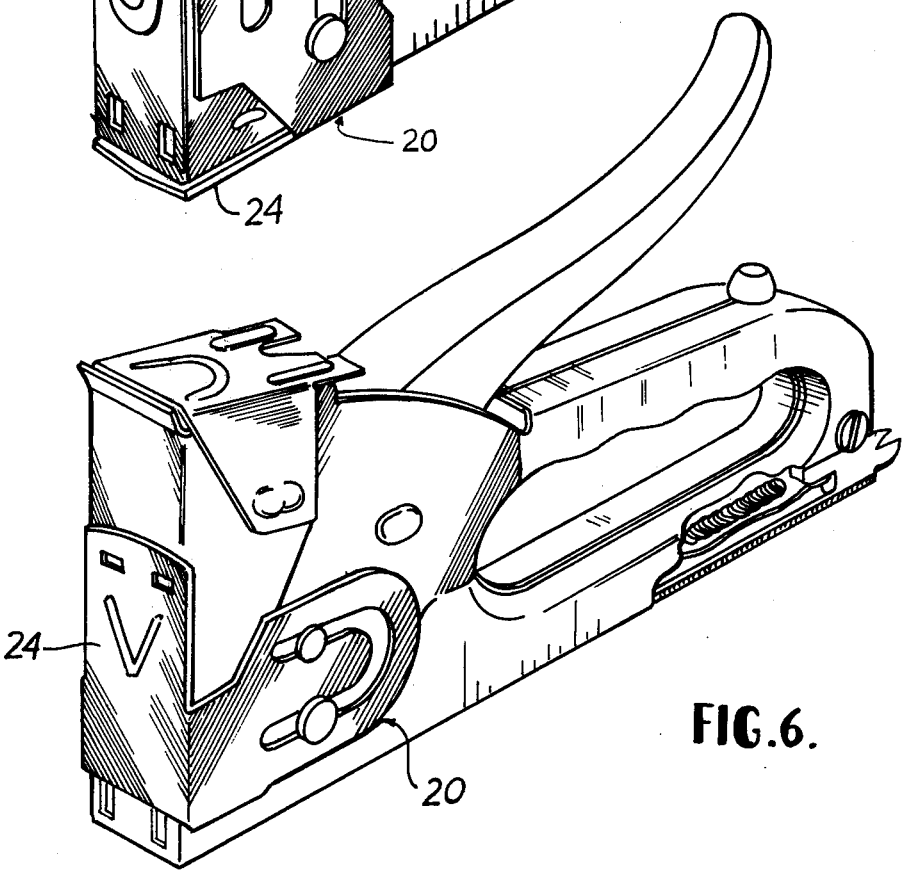

The structures of said movable fitting 20 and said check plate 30 are more detailedly disclosed by reference to FIG. 2. Said movable fitting 20 is bent forming a backing panel and two side walls each containing a slot 21. An extra protuberance 22 is also included on one of the side walls whereby to provide a means for locking the fitting 20 in the desired positions by engaging recesses in the body of the stapling machine. The movable fitting 20 mounts on the body of said stapling machine 10 by way of the pin 11 and 12 which also define two alignment points for said fitting 20 to slide along the slot 21. Two recesses 23 are pressed upon said backing panel 24 in order that when used in paper-fastening, said panel 24 with recesses 23 serve as an accepting means to clinch the staples driven through those papers. For general purpose use, the movable fitting 20 is slided along the slot 21 to a position, i.e., said backing panel 24 being perpendicular to the base 50 (see FIG. 6). Said movable fitting 20 can also be adjusted to locate just beneath the base 50 (see FIG. 7) so that the panel 24 blocks the outlet of the staples thus preventing any harm causes by abuse of the machine.

Referring to FIG. 2, the check plate 30 includes two projections 32, one check tip 33 and a pair of corresponding eyes 31 formed in the two side walls thereof. Said check plate 30, by protruding a pin 13 through said eyes 31, mounts on the body 10 forming a lock means for said grip arm 14. When the stapling machine is not in operation, the check plate 30 is moved toward said grip arm 14 whereby said check tip 33 contacts the front end of the protrusion 141 of said grip arm 14.

Figure 3:
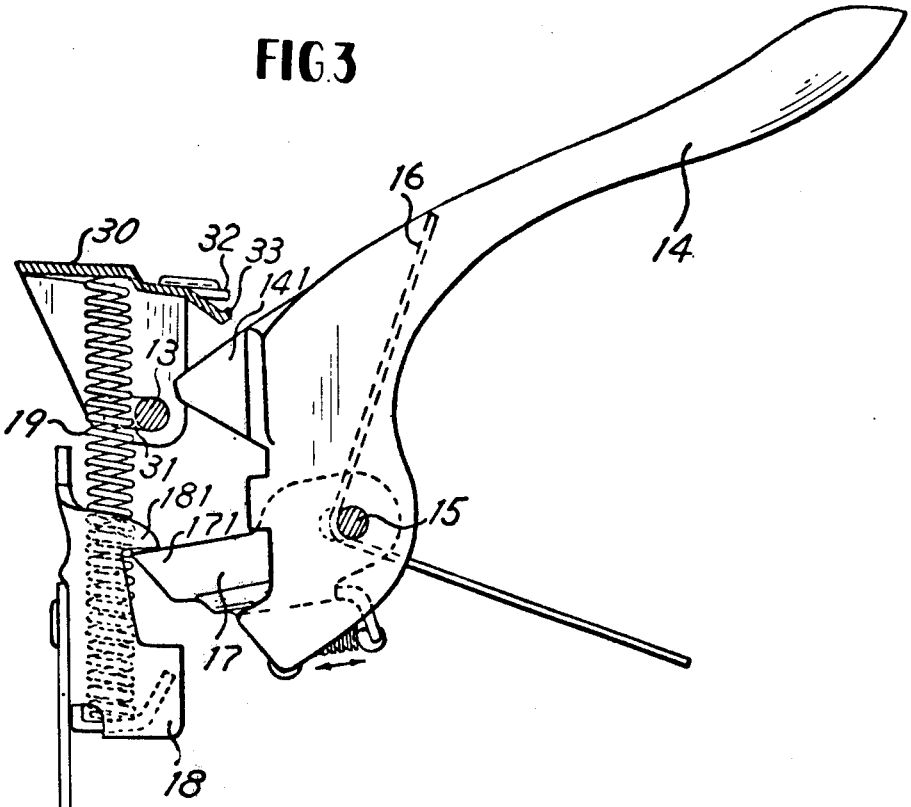
FIG. 3 shows the transverse elevation of the spring mechanism in pre-energy-storing condition according to the invention.
Figure 4:
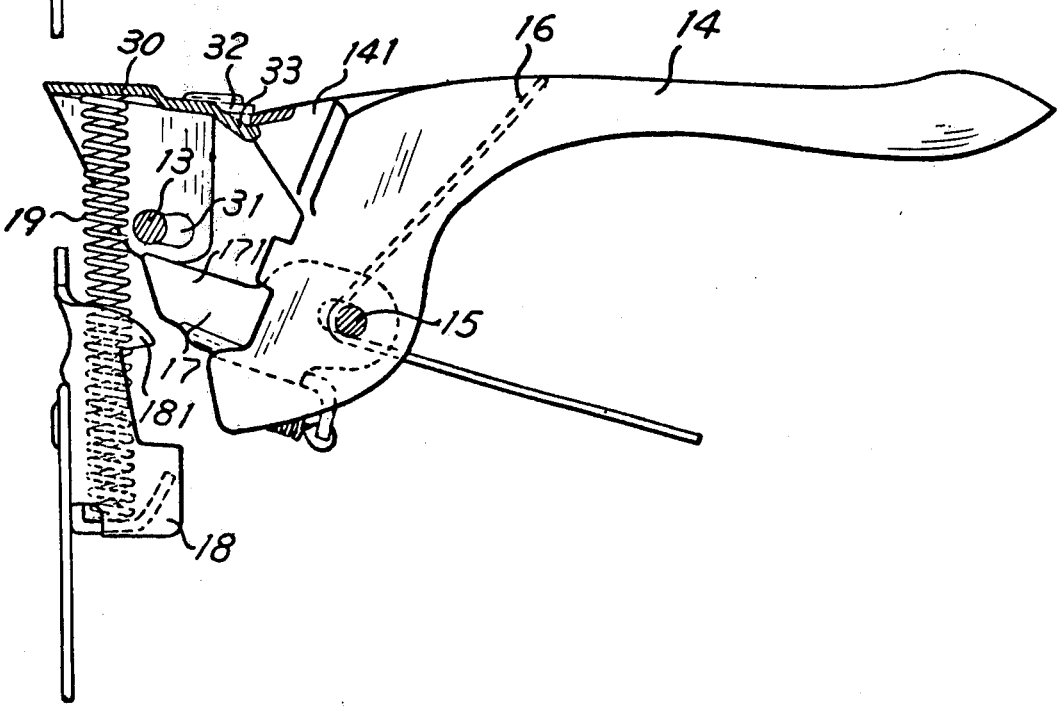
FIG. 4 shows the transverse elevation of the spring mechanism in energy-released condition according to the present invention.

FIG. 3 and 4 show how the spring-energized stapling machine is operated, wherein FIG. 3 is in a state ready to store energy and FIG. 4 shows the machine in energy-released condition with the protrusion 141 of said grip arm 14 blocked by the check tip 33 as stated hereinabove.

Along both sides of the base 50 of said body 10, there are provided two systems of measuring scales, one in centimeters and the other in inches. Such provisions make the operation convenient in determining the desired spot of injection.

Figure 5:
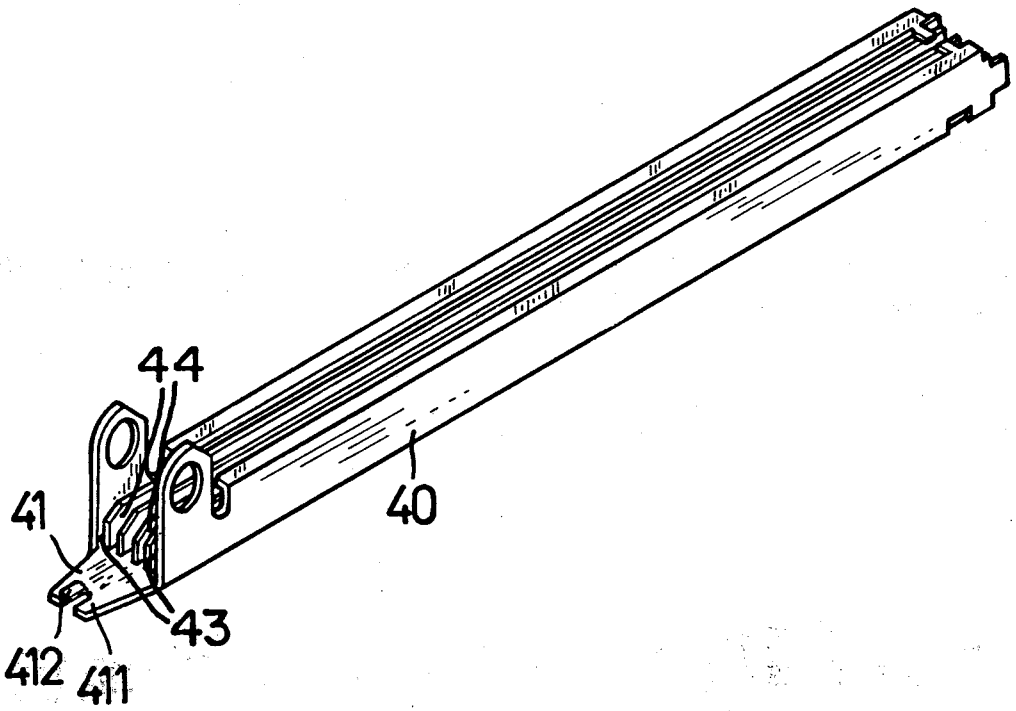
FIG. 5 is a perspective view of the staple supply according to the invention.

Referring to FIG. 5, the staple supply 40 includes two sets of grooves 43 and 44 whereby making it possible to accept staples of different sizes. At the rear of said supply 40 there are also provided with means 41 for staple removal. The means 41 comprises an upper claw 411 and a pair of lower claws 412.

What I claim is:

1. A spring-energized stapling machine for both paper-fastening and staple-injecting comprising:

a body including a base, an operating handle, and spring means for driving staples as a result of movement of said handle;

a check plate having a tip end and two parallel sides, each of said sides having a slot therein, said check plate being slidably mounted on said body by way of a pin extending through said body and through said slots in said check plate such that said check plate is slidable to a position in which the tip end of said check plate engages said operating handle and thereby obstructs the movement of said operating handle;

a movable fitting having an inverted U-shaped slot and two recesses included therein, said fitting mounting upon said body by way of two pins which also define two alignment points which said movable fitting is slidable thereabout whereby said fitting is slidable through a plurality of angularly and longitudinally displaced positions, said fitting forming a backing plate to clinch the ends of staples in said recesses as said staples are driven for paper-fastening when said fitting is in a first of said positions, said fitting forming a safety shield to preclude accidental driving of staples by blocking the path of staples driven by said spring means when said fitting is in a second of said positions, said fitting allowing the injecting of staples into objects when said fitting is in a third of said positions;

a staple supply means possessing two sets of parallel grooves to accept staples of two different sizes, said supply means being positioned to supply staples to said spring means; and means for staple removal mounted on said base.

2. The stapling machine as claimed in claim 1, further comprising measuring scales along both sides of said base of said body, said scales indicating the distance along said base from the point from which the staples are driven.

3. The stapling machine as claimed in claim 1, further comprising an opening for viewing the number of staples remaining in the staple supply means, said opening being near the front end of said supply means.

* * * * *